US005162635A

United States Patent [19]

Sato et al.

[11] Patent Number: 5,162,635

[45] Date of Patent: Nov. 10, 1992

[54] HEATER

[75] Inventors: Shigehiro Sato, Yokohama; Yoshiyuki Matsunaga, Yokosuka, both of Japan

[73] Assignee: Toshiba Lighting & Technology Corporation, Tokyo, Japan

[21] Appl. No.: 687,025

[22] Filed: Apr. 18, 1991

[30] Foreign Application Priority Data

Apr. 26, 1990 [JP] Japan ..... 2-111175

[51] Int. Cl.[5] ..... H05B 3/26

[52] U.S. Cl. ..... 219/216; 219/543; 338/195; 338/309; 338/306

[58] Field of Search ..... 219/216, 543, 549; 338/306, 309, 305, 333, 195, 308, 307; 355/282, 285; 346/76 PH

[56] References Cited

U.S. PATENT DOCUMENTS

| | | | |
|---|---|---|---|
| 3,495,070 | 2/1970 | Zissen | 219/543 |
| 3,964,087 | 6/1976 | Mallon | 338/306 |
| 4,052,588 | 10/1977 | Nakamura et al. | 219/345 |
| 4,774,397 | 9/1988 | Grise | 219/549 |

FOREIGN PATENT DOCUMENTS

| | | | |
|---|---|---|---|
| 3248203 | 6/1984 | Fed. Rep. of Germany | 219/543 |
| 57-61586 | 4/1982 | Japan . | |
| 58-155974 | 9/1983 | Japan . | |
| 59-178267 | 10/1984 | Japan . | |
| 60-180857 | 9/1985 | Japan . | |
| 2-59356 | 2/1990 | Japan . | |

*Primary Examiner*—Bruce A. Reynolds
*Assistant Examiner*—Michael D. Switzer
*Attorney, Agent, or Firm*—Cushman, Darby & Cushman

[57] ABSTRACT

A heater comprises a substrate and an electrically conductive heating section having branched portions on its lateral edge. The heating section has notches at those portions of its lateral edges that are opposite to the branched portions. The notches increase electric resistance of the heating section at the branched portions to enhance heat generation of the heating section at the branched so that the heating section is heated at a predetermined temperature over the entire length of a transfer paper sheet.

16 Claims, 3 Drawing Sheets

HEATER

BACKGROUND OF THE INVENTION

1. Field of the Invention

This invention relates to a heater for heating objects having different sizes.

2. Description of the Related Art

There have been known electronic copying machines and facsimile machines (hereinafter referred to as "electrophotographic processing apparatuses") which are operated by an electrophotographic process.

During the electrophotographic process, toner is transferred onto a paper sheet to be transferred (hereinafter referred to as the "transfer paper sheet"). The toner transferred onto the transfer paper sheet is simultaneously heated to be fused and pressed thereagainst by means of a heater such as a heat roller so that the toner is fixed to the transfer paper sheet.

Recently, an electrophotographic processing apparatus which uses the following heater instead of the heat roller is known.

The heater used in such an electrophotographic processing apparatus comprises an elongated substrate made of alumina ceramics or the like and a heating section formed by an elongated film made of silver-palladium alloy and extending along the substrate. The ends of the elongated heating section are in the general vicinity of the respective ends of the substrate. Terminals, which are connected to a power source, are provided on the respective end portions of the heating section. Based on such a heater the present inventors developed an improved heater in which an alumina substrate has a heating section of silver-palladium alloy on it and an electrode section on each end. A lead or leads, made of the same material of that of the heating section, are branched from intermediate portions of the heating section and extend along the substrate. A further terminal is provided on the free end of each lead and is selectively connected to the power source.

The terminals of the heater are selectively rendered conductive so that the portion of the heater which has a length corresponding to the size of the transfer paper sheet is heated and the temperature of the portion of the heater which the transfer paper sheet does not contact is low. This process prevents the heating section from being overheated.

However, the temperature of the portions of the heating section which the leads are branched is lower than desired, because the heating section is broadened at the branched portions so that corresponding electric resistances are reduced, thereby, lowering the temperature of the portions. Furthermore, because the leads are made of good electric conductors, heat generated at the branched portions of the heating section is easily radiated therefrom. Further, still a high thermal conductivity of the terminals causes the heat generated in the heating section to be radiated from the terminals, lowering the temperature of the portions of the heating section at the vicinity of the terminals.

Accordingly, the conventional heater has the drawback of lowering the temperature of the heating section at the branched portions and at the leads.

Even if the temperature is unevenly distributed on the surface of the heating section, the toner is well fixed to the transfer paper sheet at the portion of the heating section which is heated to a high temperature. However, the toner is not well fixed to the transfer paper sheet at the portion of the heating section which is heated to a lower temperature. Some toner easily falls off from the portion of the sheet which is at a lower temperature, resulting in an uneven fixture of the toner onto the transfer paper sheet.

SUMMARY OF THE INVENTION

The object of this invention is to provide a heater in which the temperature of a heating section is not locally lowered at the branched portions of the heating section.

In order to attain the object, a heater according to this invention comprises:

a substrate having a surface;

an electrically conductive heating section mounted on said surface of said substrate and having one end portion and the other end portion opposite thereto, said heating section forming a strip shape and including a branched portion between said one end portion and said other end portion;

a pair of electrically conductive main terminals respectively connected to said end portions of said heating section, said terminals allowing electricity to pass through said heating section enabling said heating section to generate heat;

an electrically conductive section extending from said branched portion of said heating section and having at its free end an electrically conductive auxiliary terminal; and electric resistance-increasing means for increasing an electric resistance at said branched portion of said heating section.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

This invention will now be fully understood by way of preferred embodiments with reference to the accompanying drawings in which.

DETAILED DESCRIPTION OF THE PREFERRED EMBODIMENTS

Figure 1:
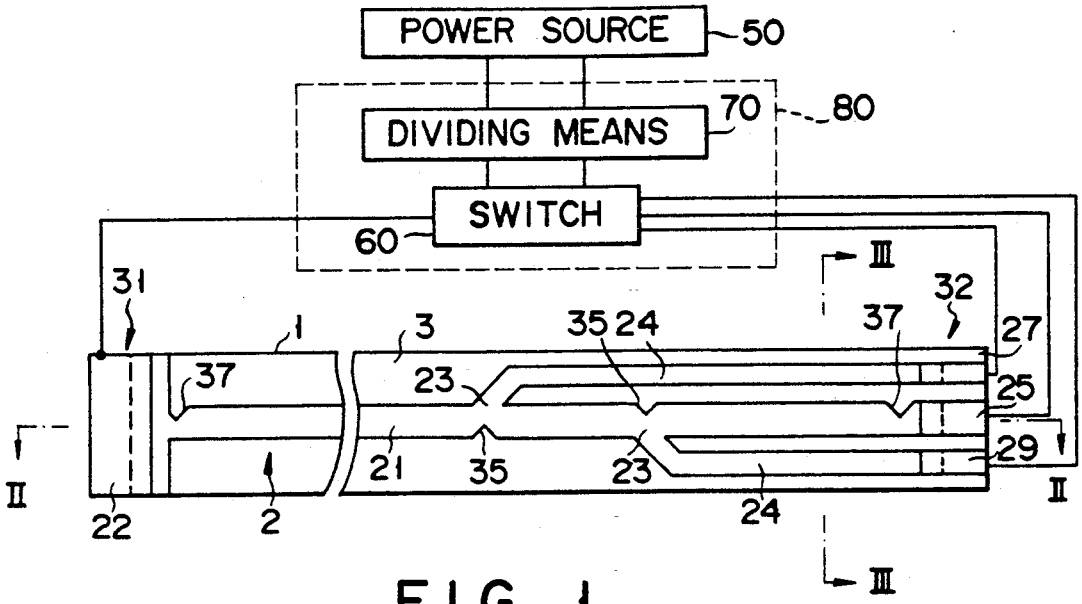
FIG. 1 is a general plan view of an embodiment of a heater according to this invention.

A first embodiment of a heater according to this invention will now be explained with reference to FIGS. 1 to 5.

The heater comprises an elongated substrate 1, made of a heat-resisting material such as alumina ceramics and having a length of 300 mm, a width of 10 mm and a thickness of 1 mm.

On the substrate 1 is formed an electro-heating unit or a heating unit 2 extending along the substrate 1 and comprising a heating section 21, an electrically conductive common terminal 22, an electrically conductive section 24, an electrically conductive second terminal 25, an electrically conductive third terminal 27 and an electrically conductive fourth terminal 29.

The heating section 21 is an elongated film made of a heat generating material such as a silver-palladium alloy and has a length of 280 mm, a width of 2 mm and a thickness of 10 μm. The heating section 21 extends along the substrate 1 so that its ends extend to first end portion 31 and a second end portion 32 of the substrate 1. The end portion of the heating section 21 which is adjacent to the first end portion 31 of the substrate 1 is broadened to have the same width of the first end portion (one end portion) 31, while the width of the second end portion 32 of the heating section 21 remains unchanged (that is, the width is 2 mm).

Figure 2:
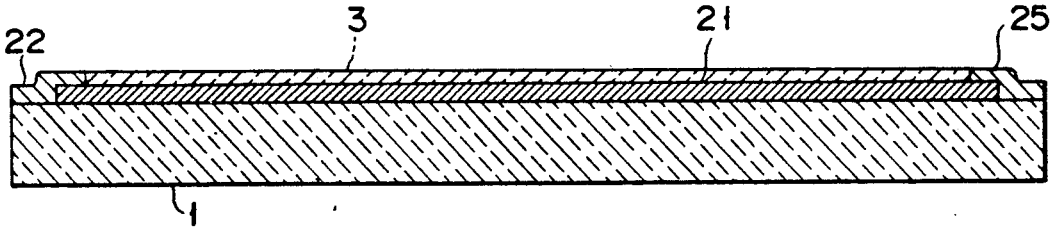
FIG. 2 is a cross-section view along line II—II of FIG. 1.

As shown in FIG. 2, the common terminal 22, which is made of silver, has substantially the same width of the substrate 1, and is formed on the portion of the silver-palladium alloy film on the first end portion 31 of the substrate 1, so as to run onto the broadened end portion of the heating section 21.

As shown in FIG. 2 again, the second terminal 25 made of silver has substantially the same width of the heating section 21 (that is, 2 mm), and is formed on the portion of the silver-palladium alloy film on the second end portion 32 of the substrate 1, so as to extend onto the end portion of the heating section 21.

Elongated electrically conductive sections 24, each made of the same material as the heating section 21, i.e., a silver-palladium alloy, and having a width of approximately 1.5 mm, extend on both side of the heating section 21 from two branched portions 23, formed at different places on the heating section 21, to the vicinity of the second end portion 32. The third and fourth terminals 27 and 29 which are made of silver have substantially the same width of the respective electrically conductive sections 24 (that is, 1.5 mm) and are formed on the second end portion 32 of the substrate 1, so as to extend onto the extended end portions of the electrically conductive sections 24 (see FIG. 2).

Figure 4:
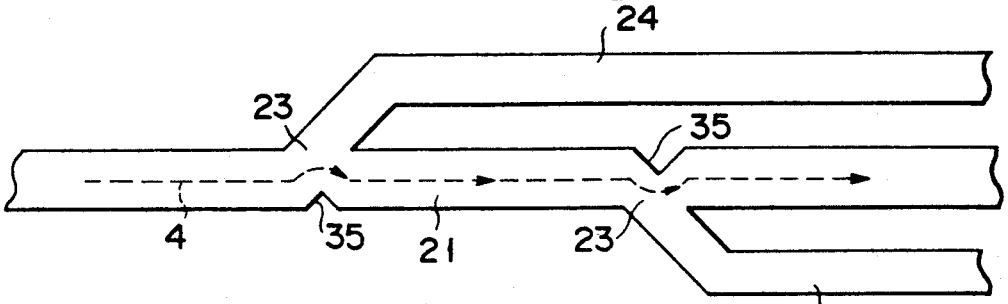
FIG. 4 is an enlarged plan view of a heating section and an electrically conductive section constituting the heater of FIG. 1.

As shown in an enlarged scale in FIG. 4, cutout portions or substantially triangular notches 35 for increasing the electrical resistances at the branched portions 23 are formed at those portions of the lateral edges of the heating section 21 which are disposed opposite to the branched portions 23, and substantially triangular notches 37 (see FIG. 1) are formed at those portions of both ends of the heating section 21 which are adjacent to the common terminal 22 and the second terminal 25, so that the temperature of the heating section 21 is not locally reduced. Note that the heating section 21 is formed by baking a silver-palladium in a paste state having been subjected to a screen printing and the silver terminal 22, 25, 27, 29 by baking silver in a paste state having been subjected to a screen printing. It is possible to form the cutout portions by cutting out the conductive heating section 21 after the conductive heating section 21 has been provided. However, in the embodiment below, the shape of the screen for screen printing is prepared so that the cutout portions are formed when the conductive heating section 21 is printed.

It should also be noted that each terminal is connected through a switch 60 and dividing means 70 to a power source 50.

Figure 3:
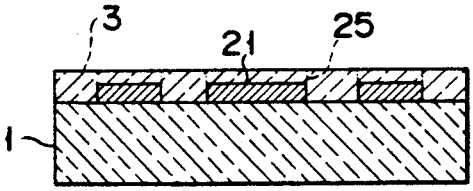
FIG. 3 is a cross-sectional view along line III—III of FIG. 1.

As shown in FIGS. 2 and 3, the whole length of the heating section 21 and the electrically conductive sections 24, the common terminal 22, and the second to fourth terminals 25, 27 and 29 are covered with a protective film 3 of a glass material.

The operation of this embodiment of the heater according to this invention will now be explained.

When, for example, toner is to be fixed to a narrow transfer paper sheet, the switch 60 is operated by the dividing means 70 to connect the power source 50 to the common terminal 22, the second terminal 25 and the third terminal 27 or to connect the power source 50 to the common terminal 22, the second terminal 25 and the fourth terminal 29. Since the portion of the heating section 21 between the branched portions 23 and the second end portion 32 (hereinafter referred to as the "first in-between portions") and the electrically conductive sections 24 are connected to the power source 50 in parallel, an electric current from the common terminal 22 is divided at the respective branched portion 23 to flow through the first in-between portion of the heating section 21 and the corresponding electrically conductive section 24, whereby the electric current flowing through the first in-between portion of the heating section 21 is halved.

In general, heat generated in a heating element is proportional to the square of the value of the current flowing therethrough. When the value of the current is halved, therefore, the heat to be generated by the heating element is reduced to one-fourth.

Accordingly, where the current flowing thorough the first in-between portion of the heating section 21 is halved as described above, the heat generated in the in-between portion is reduced to one-fourth ,thereby lowering the temperature of the first in-between portion.

The full current flows through the portion of the heating section 21 between its end portion adjacent to the first end portion 31 and the respective branched portion 23 (hereinafter referred as the "second in-between portion), whereby the temperature of the second in-between portion is much higher than that of the first in-between portion. As a result, the toner is fused well on the second in-between portion and thus is fixed only onto the narrow transfer paper sheet.

On the other hand, when toner is to be fixed to a wide transfer paper sheet, the switch 60 is operated by the dividing means 70 to connect the power source 50 to the common terminal 22 and the second terminal 25. As shown in FIG. 4, an electric current 4 flows through the whole length of the heating section 21 between the common terminal 22 and the second terminal 25 so that the current flows through the narrowed portions defined between the notched portions 35 and the corresponding branched portions 23. Consequently, some part of the heat generated in the heating section 21 escapes from the branched portions 23 to the electrically conductive sections 24.

As is known well, an electric resistance is inversely proportional to the cross-sectional area of an electric conductor through which an electric current flows. Thus, the smaller the electrical area of the conductor, the larger the electric resistance.

As the cross-sectional areas of the heating section 21 at the branched portions 23 decrease, the electric resistance per unit of length in an axial direction at the branched portions 23 increases, whereby heat generated per unit of length in an axial direction in the heating section 21 at the branched portions 2 is greater than that at the portions of the heating section 21 in the vicinity of the branched portions 23. The increased amount of the heat generated per unit of length in an axial direction supplements the amount of heat escaped from the branched portions 23 to the electrically conductive sections 24. In consequence, the temperature of the branched portions 23 is kept at substantially the same level as that of other portions of the heating section 21 and the local lowering of the temperature of the heating section 21 is prevented.

Substantially triangular notches 37 (see FIG. 1) are formed in the portions of the heating section 21 which are adjacent to the common terminal 22 and the second terminal 25 so that the heating section 21 is narrowed at these portions. Since the heat generated per unit of length at these portions is increased, the amount of heat escaping to the common terminal 22 and the second terminal 25 is supplemented, preventing the lowering of the temperature at those portions.

The temperature of the heating section 21 is equally raised to a predetermined temperature over substantially its entire length so that the toner is well fixed where applied over the entire surface of a wide transfer paper sheet including its both lateral edges.

Figure 5:
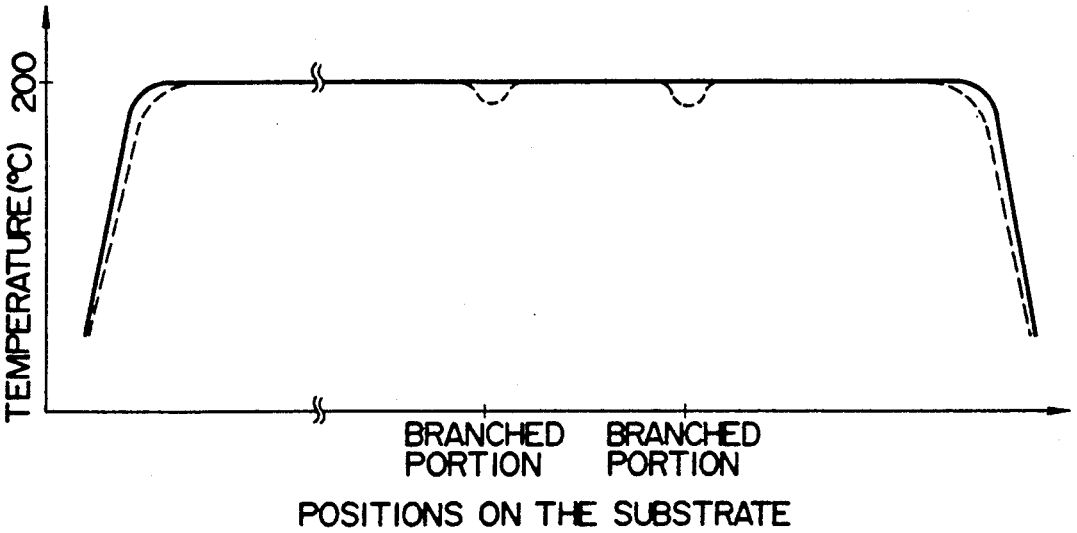
FIG. 5 is a chart showing a temperature distribution on the surface of the heater of FIG. 1.

The temperature was measured at various places on the protective film 3 of a heater prepared according to the above-mentioned embodiment of this invention and the results are shown in FIG. 5.

In this chart, the positions of the substrate 1 are taken as abscissas and the temperature on the surface of the protective film 3, as ordinates, wherein the solid line indicates the temperature distribution of the embodiment and the dot-line curve shows the temperature distribution of the comparative sample. This chart shows that the temperature distribution of this embodiment is uniform and a high temperature is maintained throughout the whole range of the heating section 21. It is noted that the temperature at the branched portions 23 is prevented from being lowered and the range of the uniform temperature extends to the end portions of the heating section 21 which are adjacent to the common terminal 22 and the second terminal 25, respectively. It is understood, therefore, that the toner fixed range or the effective toner-fixed length of a transfer paper sheet is much larger in this embodiment than in the comparative sample. This structure of the heater according to this embodiment, therefore, enables the toner to be fixed to the transfer paper sheet over its full width, preventing the uneven fixation of the toner onto the transfer paper sheet.

Figure 6:
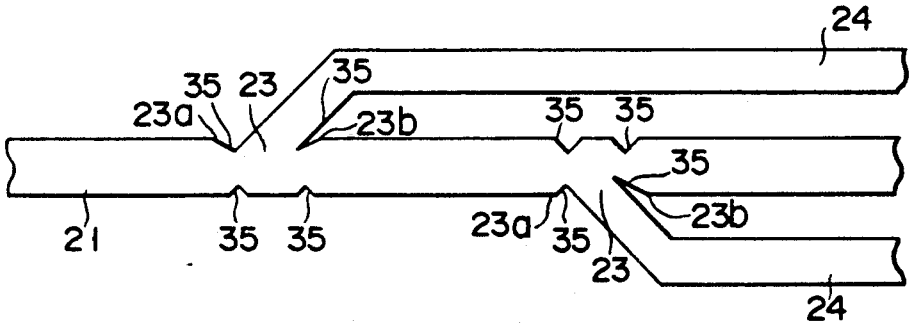
FIG. 6 is an enlarged plan view of a heating section and an electrically conductive section of a first modification of the heater according to the embodiment of FIG. 1.

This embodiment can be modified without changing the scope of this invention. FIG. 6 shows the main part of the heater of a first modification of the embodiment, in which the first same elements and portions as those of the embodiment are designated by the same reference numerals, the description thereof being omitted.

The heating section 21 has notches 35 at those portions of one of its lateral edges where lateral portions 23*a* and 23*b* are located and at those portions of the other of its lateral edges that are opposite to the edges 23*a* and 23*b*. However, any other shape of the notches 35 is feasable as long as the notches 35 are formed in either or both of the lateral edges of the heating section 21 by cutting away the respective lateral edge thereby enabling the heat escaping from branched portions 23 to electrically conductive sections 24 to be supplemented, and so that the notches 35 are formed close to the portions of the heating section 21 at which the temperature would otherwise be lowered.

Figure 7:
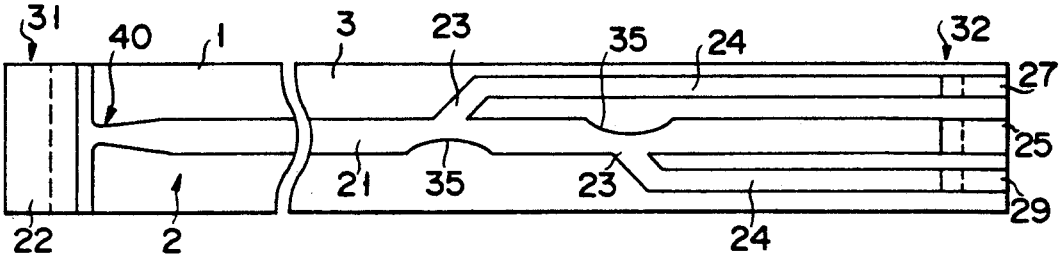
FIG. 7 is a general plan view of a second modification of the heater according to the embodiment of FIG. 1.

FIG. 7 shows a second modification of the embodiment of the heater, in which the same elements and portions as those of the embodiment are designated by the same reference numerals, the description thereof being omitted.

In the heater of the second modification, the heating section 21 has arcuated notches 35, formed in such a manner that the portions of a heating section 21 at branched portions 23 are gradually and continuously narrowed. The heating section 21 has at its one end adjacent to the common terminal 22 a tapered portion 40 having its width rendered more narrow as it approaches the common terminal 22. Since the electric resistance at the branched portions 23 is large due to the arcuated notches 35, the amount of heat generated at these portions increases, thereby supplementing the heat escaping therefrom. The heating section 21 is hardly broken down, since the arcuated notches 35 provided at the branched portions 23 gradually narrow the width of the heating section 21. Further, the tapered portion 40 narrows the end portion of the resultant heating section 21 so that the amount of heat generated per unit length increases to supplement the heat escaping to the common terminal 22. This structure, therefore, prevents the local lowering of the temperature at the common terminal 22. The heating section 21 is hardly broken down at its end portion connected to the common terminal 22, since the tapered portion 40 gradually narrows the end portion of the heating section 21.

Figure 8:
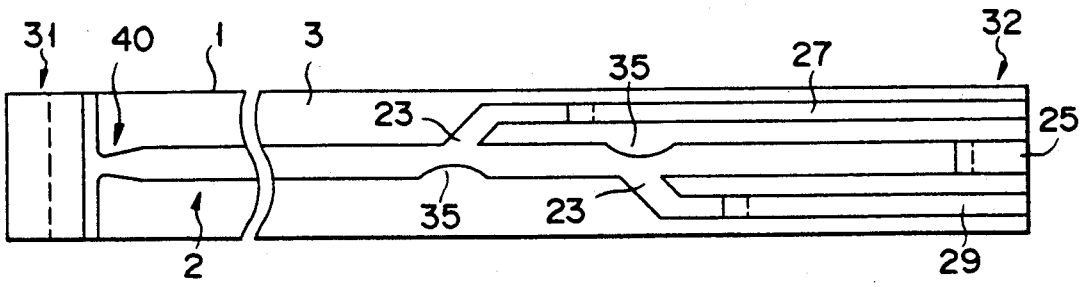
FIG. 8 is a general plain view of a third modification of the heater according to the embodiment of FIG. 1.

FIG. 8 shows a third modification of the embodiment of the heater, in which the two electrically conductive sections 24 of the embodiment are replaced by an elongated third terminal 27 and an elongated fourth terminal 29, respectively.

Figure 9:
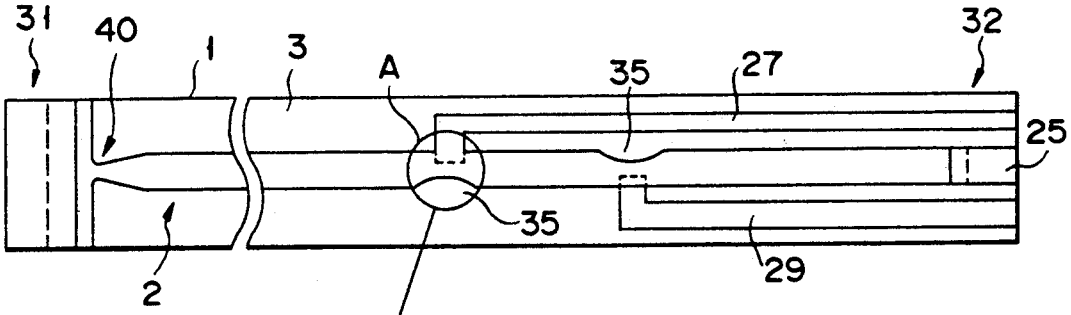
FIG. 9 is a general plan view of a fourth modification of the heater according to the embodiment of FIG. 1.

FIG. 9 illustrates a fourth modification of the first embodiment of the heater, in which the same elements and portions as those of the first embodiment are designated by the same reference numerals, the description thereof being omitted.

Figure 10:
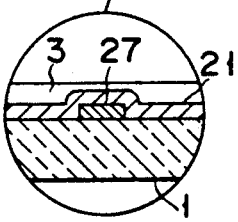
FIG. 10 is an enlarged view of the encircled portion A of the heater of FIG. 9.

In the fourth modification, the two electrically conductive sections 24 and the branched portions 23 of the embodiment are replaced, respectively, by an elongated third terminal 27 and an elongated fourth terminal 29, the inner end portions of which are joined to the corresponding portions of the edges of the heating section 21, as shown in FIG. 10. Arcuated notches 35 are formed in those portions of the lateral edges of the heating section 21 which are disposed opposite to the joined end portions of the terminals 27 and 29. This structure allows an electric resistance to be increased at the junctions between the heating section 21 and the terminals 27 and 29 so as to enhance the amount of the heat generated at the junctions. Consequently, the heat dissipated from the junctions to the terminals 27 and 29 is supplemented, thereby preventing the lowering of the temperature at the junctions.

The notches 35 and 37 may assume another shape such as a triangular or arcuated shape. Further, the portions of the heating section 21 which correspond to the notches 35 are made thinner than other portions of the heating section 21 so that an electric resistance is increased there.

The structure of the heater is not limited to the ones as explained above. What this invention requires is that the heater comprises the heating section 21 made of an elongated film of heat generating material, at least one electrically conductive section 24 branched from at least one branched portion formed at a required portion of the heating section 21, and means for increasing electrical resistance provided at the electrically conductive section. The electrically conductive section 24 may be of ruthenium oxide ($RuO_2$) or made of silver. The structure and arrangement of the terminals may be changed according to the design of the heater. Needless to say, the heater according to this invention is applicable to various fields other than the field of an electrophotographic processing apparatus.

Figure 11:
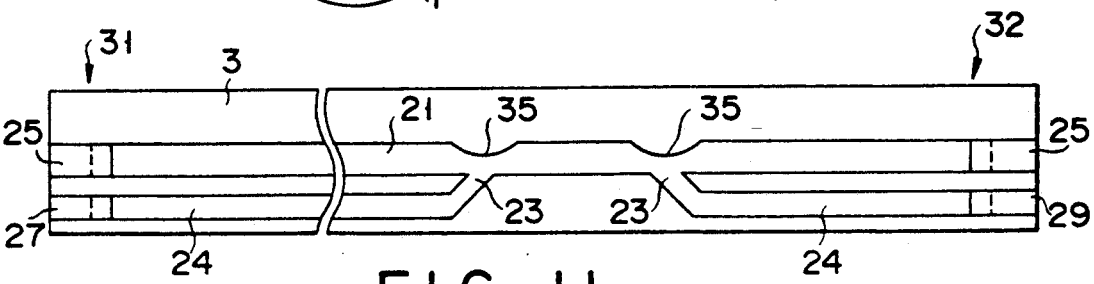
FIG. 11 is a general plain view of a fifth modification of the heater according to the embodiment of FIG. 1.

Furthermore, the protective film 3 is not necessary. The branched portions 23 are not limited to the above embodiments. For instance, it is possible to provide them as shown in FIG. 11. In this fifth modification, the electrically conductive sections 24 extend on one side of the heating section 21 from two branched portions 23, formed at different places on the heating section 21, to the vicinity of the first end portion 31 and the second end portion 32.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A heater comprising:

a substrate having a surface;

an electrically conductive heating section mounted on said substrate surface and having first and second opposite end portions, said heating section forming a strip shape and including a branched portion between said first and second opposite end portions;

a pair of electrically conductive main terminals respectively connected to said first and second opposite end portions of said heating section, said terminals allowing electricity to pass through said heating section thereby enabling said heating section to generate heat;

an electrically conductive section extending from said branched portion of said heating section and having at its free end an electrically conductive auxiliary terminal; and electric resistance-increasing means for increasing an electric resistance at said branched portion of said heating section.

2. A heater according to claim 1, wherein said electric resistance-increasing means has a cutout portion that is opposite to said electrically conductive section, to increase an electric resistance of said heating section at said branched portion.

3. A heater according to claim 2, wherein said electrically conductive heating section is a film.

4. A heater according to claim 2, wherein said electrically conductive section is a film.

5. A heater according to claim 2, wherein said terminals are films.

6. A heater according to claim 2, wherein said heating section, said conductive section and said terminals are films.

7. A heater according to claim 6, wherein said films are formed on said substrate by a screen printing.

8. A heater according to claim 2, wherein said cutout portion forms an arcuate figure.

9. A heater according to claim 7, wherein said heating section and said electrically conductive section are made of the same material.

10. A heater according to claim 9, wherein said heating section and said conductive section are formed as one continuous body.

11. A heater according to claim 1, wherein said heating section and said electrically conductive section are made of different material from each other.

12. A heater according to claim 1, wherein said heating section has another electric resistance-increasing means provided close to at least one of said terminals, for increasing an electric resistance of the portion of said heating section which is in the vicinity of at least one of said main terminals.

13. A heater according to claim 12, wherein said another resistance-increasing means has a cutout portion for increasing an electric resistance of the portion of said heating section.

14. A heater comprising:

a substrate having a surface;

an electrically conductive heating section mounted on said surface of said substrate and having first and second opposite end portions, said heating section forming a strip shape and including a branched portion between said first end portion and said second end portion;

a pair of electrically conductive main terminals, respectively connected to said first and second opposite end portions of said heating section;

an electrically conductive section extending from said branched portion of said heating section and having at its free end an electrically conductive auxiliary terminal;

electric resistance-increasing means for increasing an electric resistance at said branched portion of said heating section; and means for supplying electric power to said heating section through said terminals, said supplying means including means for switching said main terminals and said auxiliary terminal to be supplied with electric power so that said heating section partially generates heat.

15. A heater apparatus comprising:

a substrate having a surface;

an electrically conductive heating section mounted on said surface of said substrate and having first and second opposite end portions, said heating section forming a strip shape and including a branched portion between said first end portion and said second end portion;

a pair of electrically conductive main terminals respectively connected to said end portions of said heating section, said terminals allowing electricity to pass through said heating section so that said heating section generates heat;

an electrically conductive section extending from said branched portion of said heating section and having at its free end an electrically conductive auxiliary terminal; and temperature maintenance means for maintaining a temperature at said branched portion relative to remaining portions of said heating section.

16. A heating apparatus according to claim 14, wherein said supplying means includes means for dividing electric power at said branched portion.

* * * * *